US012552627B2

(12) United States Patent
Schubring

(10) Patent No.: US 12,552,627 B2
(45) Date of Patent: Feb. 17, 2026

(54) MODEL REFERENCE ADAPTIVE WEB AND WINDING CONTROL

(71) Applicant: BW Converting, Inc., Green Bay, WI (US)

(72) Inventor: Cory L. Schubring, De Pere, WI (US)

(73) Assignee: BW Converting, Inc., Green Bay, WI (US)

( * ) Notice: Subject to any disclaimer, the term of this patent is extended or adjusted under 35 U.S.C. 154(b) by 90 days.

(21) Appl. No.: 18/660,612

(22) Filed: May 10, 2024

(65) Prior Publication Data

US 2024/0391720 A1 Nov. 28, 2024

Related U.S. Application Data

(60) Provisional application No. 63/469,130, filed on May 26, 2023.

(51) Int. Cl.

| | |
|---|---|
| ***B65H 18/28*** | (2006.01) |
| ***B65H 23/04*** | (2006.01) |
| ***B65H 23/188*** | (2006.01) |
| ***B65H 23/192*** | (2006.01) |

(52) U.S. Cl.

CPC ..... *B65H 18/28* (2013.01); *B65H 23/044* (2013.01); *B65H 23/1888* (2013.01); *B65H 23/192* (2013.01); *B65H 2513/11* (2013.01); *B65H 2515/32* (2013.01); *B65H 2557/262* (2013.01); *B65H 2701/1924* (2013.01)

(58) Field of Classification Search

CPC ..... B65H 23/044; B65H 23/192; B65H 23/1888; B65H 18/28; B65H 2515/31; B65H 2515/81

See application file for complete search history.

(56) References Cited

U.S. PATENT DOCUMENTS

| | | | | |
|---|---|---|---|---|
| 6,755,940 | B2 | 6/2004 | Lin et al. | |
| 7,000,864 | B2 | 2/2006 | McNeil et al. | |
| 7,127,951 | B2 | 10/2006 | Sartain et al. | |
| 7,144,356 | B2 * | 12/2006 | Harnish | B65H 45/08 493/17 |

(Continued)

FOREIGN PATENT DOCUMENTS

| | | | |
|---|---|---|---|
| EP | 3620412 | A1 | 3/2020 |
| WO | 2019185438 | A1 | 10/2019 |
| WO | 2020160473 | A1 | 8/2020 |

*Primary Examiner* — Sang K Kim

(74) *Attorney, Agent, or Firm* — Thompson Coburn LLP

(57) ABSTRACT

In a controller for a converting line: (a) mechanical characterization module generates an estimate of an applied web force at a driven roller based upon velocity and torque signals, and mechanical properties associated with an upstream and downstream roller, one or both of which may be the driven roller; (b) a web stiffness estimator module generates a span stiffness estimate, a previous span tension estimate, and a span time constant based upon the span length, the velocity signals from the upstream and downstream roller sensors, a span tension signal from the span tension sensor, and the applied web force estimate from the mechanical characterization module; and (c) a tension control module generates a velocity trim command signal for the driven roller based on the span stiffness estimate, the previous span tension estimate, a web span time constant, a span tension signal, and a span tension setpoint.

18 Claims, 12 Drawing Sheets

(56) References Cited

U.S. PATENT DOCUMENTS

| | | | | |
|---|---|---|---|---|
| 9,221,641 | B2 | 12/2015 | Dollevoet et al. | |
| 9,845,574 | B2 | 12/2017 | Bomstad et al. | |
| 10,227,197 | B2 | 3/2019 | DeBruler et al. | |
| 10,618,763 | B2 | 4/2020 | Kirchhoff et al. | |
| 10,730,274 | B2 | 8/2020 | Gussert et al. | |
| 11,174,595 | B2 | 11/2021 | Montagnani et al. | |
| 11,247,863 | B2 | 2/2022 | Techlin et al. | |
| 11,254,535 | B2 | 2/2022 | Schubring et al. | |
| 11,261,045 | B2 | 3/2022 | Spinelli | |
| 11,434,096 | B2 | 9/2022 | Petras et al. | |
| 11,691,839 | B2 | 7/2023 | Schubring et al. | |
| 12,049,372 | B2 | 7/2024 | Techlin et al. | |
| 2002/0108983 | A1 | 8/2002 | Cote et al. | |
| 2010/0269720 | A1 | 10/2010 | Schnabel et al. | |
| 2017/0282601 | A1* | 10/2017 | Boland ..... | B65H 20/02 |
| 2019/0301099 | A1 | 10/2019 | Montagnani et al. | |
| 2019/0308839 | A1 | 10/2019 | Schubring et al. | |
| 2020/0385227 | A1 | 12/2020 | Petras et al. | |

* cited by examiner

MODEL REFERENCE ADAPTIVE WEB AND WINDING CONTROL

RELATED APPLICATION DATA

This application claims priority benefit of U.S. provisional application Ser. No. 63/469,130, filed May 26, 2023, the disclosure of which is incorporated by reference herein.

FIELD OF THE DISCLOSURE

This disclosure is directed to a web and winding control system for the production of roll products, and more particularly, for the production of rolls of bathroom tissue and household towel. The control system described herein provides for web and winding control strategies for sustained high throughput production of rolls of high quality. The control system presents the operator with information to help the operator make informed decisions in operating the converting line, or automatically makes the adjustments to the converting line and informs the operator of the adjustments.

BACKGROUND AND SUMMARY

Whether bathroom tissue or household towel, or other related products such as facial tissue and napkins, the steps in the production of such products include: (i) papermaking or the production of parent rolls; (ii) converting the parent rolls into consumer use rolls by unwinding one or more parent rolls and rewinding them into logs and then cutting the logs into consumer size rolls with a series of machines in a converting line; and (iii) packaging the rolls by one or more of wrapping, bundling, case-packing, palletizing, and shrink-wrapping for shipment to retailers and the like.

Historically, some producers of bathroom tissue and household towel viewed papermaking, converting, and packaging as discrete process units, often with competing and conflicting goals. Today, the most successful producers of roll products view the entire process as an integrated system with a common goal of saleable, profitable product shipped to customers. As part of that system, there is a need for converting equipment to be more operator friendly, easier to use, and capable of supporting consistent production with webs of varying and changing properties.

The typical converting line converts large parent rolls into logs and then into smaller rolls for consumer use. The parent rolls may be of sufficient width to be cut, for example, into around 14-34 rolls of bathroom tissue between about 100 mm and 115 mm (about 4 and 4.5 inches) long, or around 6-15 rolls of household towel between about 230 mm and 280 mm (about 9 and 11 inches) long. Parent rolls may have a width of 2750 mm (108 inches), or 3500 mm (138 inches), and greater. Other parent rolls may have width of as little as 1600 mm (63 inches), and less. A converting line for producing rolls of bathroom tissue and household towel may comprise, for example and not in any limiting sense, one or more unwind stations, an embosser-laminator, a rewinder, a tail seal unit, a log accumulator, and one or more log saws. Of those, the machines involving web handling and winding are shown in FIG. 1. The rewinder may be a surface rewinder, as shown in FIG. 1. In the alternative, the rewinder may be a center rewinder, in which the log is supported and rotationally driven by a spindle, axle, or shaft within the log. For producing coreless products with a surface rewinder, logs may be wound on reusable mandrels; such a converting line may have an additional mandrel extractor module located between the tail seal unit and the accumulator to remove the mandrels from the logs and return the mandrels to the rewinder.

By way of example, the unwind station may be in accordance with U.S. Pat. No. 11,254,535; the embosser-laminator may be in accordance with U.S. Pat. No. 10,730,274; the rewinder may be in accordance with one of the several examples shown in U.S. Pat. No. 11,247,863; and the log formation and winding process may be assessed, and the converting line controlled based on said assessments, in accordance with the principles described in U.S. Pat. No. 11,261,045. The disclosures all of these references are incorporated by reference herein. The log accumulator may be in accordance with EP 3620412, the disclosure of which is incorporated by reference herein.

The state of the art in web and winding control strategies for sustained high throughput production of rolls of high quality may be classified into one of three categories: paper defect tracking, parent roll property compensation, and paper caliper control/compensation.

Paper defect tracking involves identifying, during the manufacture of a parent roll, locations within the parent roll where out-of-specification paper properties occur. When that parent roll is unwound in the converting line, the speed of the converting line is reduced as the defect approaches and remains reduced until the defect is past, or the line is stopped to allow an operator to remove the defective paper, depending on the nature and severity of the defect. So, conventional controls that are premised on parent roll paper defect tracking depend upon at least in part on systems for measuring parent roll diameter and web caliper (so as to determine the amount of web unwound from the roll), and information regarding the nature of the defect. Examples of paper defect tracking methodologies for control systems are described in U.S. Pat. Nos. 9,845,574 and 11,254,535. Control system methodologies may also be based on other parent roll properties and defects. An example of a control system directed to addressing a parent roll out-of-round condition is shown in U.S. Pat. Nos. 10,227,197 and 11,254,535, and WO 2020/160473A1. An example of parent roll density compensation is found in U.S. Pat. No. 9,221,641.

Paper caliper control involves measuring the thickness of the paper prior to winding it, comparing it to a target caliper, and adjusting a process upstream of the rewinder, typically an embossing nip or a calender nip, until the measured caliper is within a target range. In another approach to caliper control, the measured firmness or compressibility of a roll or log is used to indicate whether the paper caliper has changed. Paper caliper compensation is similar to paper caliper control, except that instead of adjusting a process upstream of the rewinder to return a caliper to a target range, rewinder process parameters, for example, winding tensions, are adjusted to compensate for the changing caliper. Paper caliper control or compensation may be achieved on the input side by measuring caliper directly, by measuring finished roll/log properties, and/or by measuring parent roll diameter; and on the output side, by adjusting a caliper control device, for example an embosser or a calendar, or by adjusting a rewinding device. U.S. Pat. No. 6,755,940 provides an example of a control system for measuring caliper and controlling a calender device. U.S. Pat. No. 7,000,864 provides an example of a control system for compensating for caliper changes by using roll/log measurements to adjust a winding profile. U.S. Pat. No. 7,127,951 provides an example of a control system for measuring log firmness and adjusting a caliper control device, for example an embosser or a calender, accordingly. U.S. Pat. No. 11,174,595 provides a means of measuring paper caliper as the web passes over a roller. U.S. Pat. No. 11,254,535 provides a means of determining paper caliper from measurements of parent roll diameter. WO 2019/185438A1 provides an example of a log measurement station, and for adjusting converting line production parameters based on measured log properties. U.S. Pat. No. 11,434,096 provides for a model reference adaptive control for controlling a calendar load based on parent roll diameter and finished roll characteristics.

The strategies described above leave unexplored opportunities for improvements in the web and winding control system in the converting line. In the current state of the art, the various proportional-integral (PI) web tension control loops have gains determined by the lowest common denominator condition, namely, the web that runs unstable. These gains are determined empirically during test and commissioning of a converting line. Converting lines, especially those that run fragile paper grades, for example, through-air-dried (TAD) or other structured or textured grades such as NTT, QRT, ATMOS, and eTAD, may require a significant number of driven elements in the web path. The number of driven elements in the converting line may lead to a significant number of potential adjustments that must be made. A control system for such a converting line may require a significant number of inputs from an operator of the system, and often there is difficulty in providing to an operator clear direction in whether an adjustment is needed, and if so, in which direction to make the adjustment, or even how to make the adjustment. There is a clear need for an intelligent and adaptive web and winding control system to eliminate the drawbacks of the prior art.

The disclosure herein is directed to a model reference adaptive control (MRAC) for web handling and winding. The control system allows the use of inputs from conventional converting line hardware to estimate paper properties actively and then apply those estimated parameters to a control model of the converting line. The control system provides control loops which adapt and remain stable for all grades of paper. The control system provides for faster response and better tension tracking. The control system enables a greatly simplified user interface with intelligent operational limits. The control system makes a converting line easier to operate by operators with less specialized knowledge. The control system allows a converting line to adapt intelligently and automatically to changing input materials and converting process settings. The control system provides for adjusting web control parameters and/or winding control parameters, depending on which web or log property or properties change and the extent to which they change. The data generated can be used in machine analytics, for instance, to indicate how changing paper properties affect the overall equipment effectiveness (OEE) of the converting line. The control system provides for web handling control closer to the idealized theoretical control, which leads to more productivity with less downtime. Further advantages are disclosed below.

DESCRIPTION OF THE DRAWINGS

FIGS. 5-1 and 5-2 are a schematic overview of the exemplary control system.

DETAILED DESCRIPTION

Figure 1:
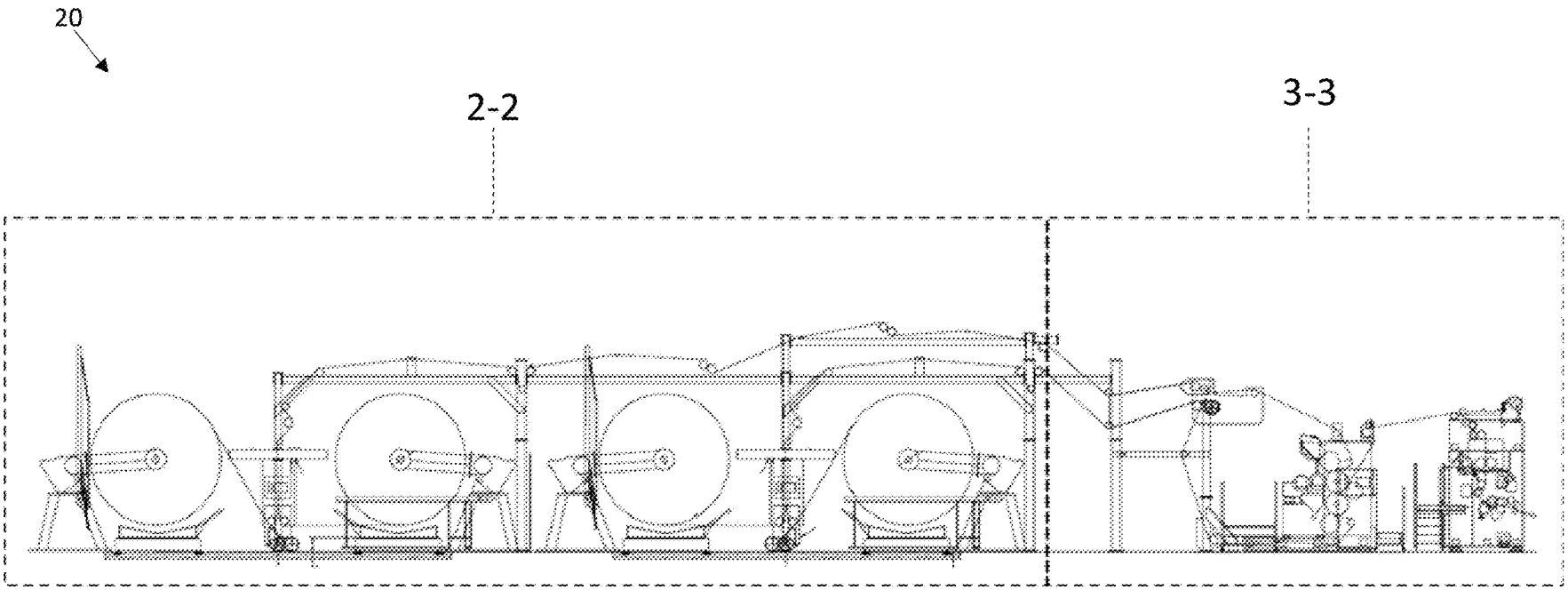
FIG. 1 is a side elevation of an exemplary converting line for producing roll products showing an unwind station, an embosser-laminator, and a rewinder.
Figure 2:
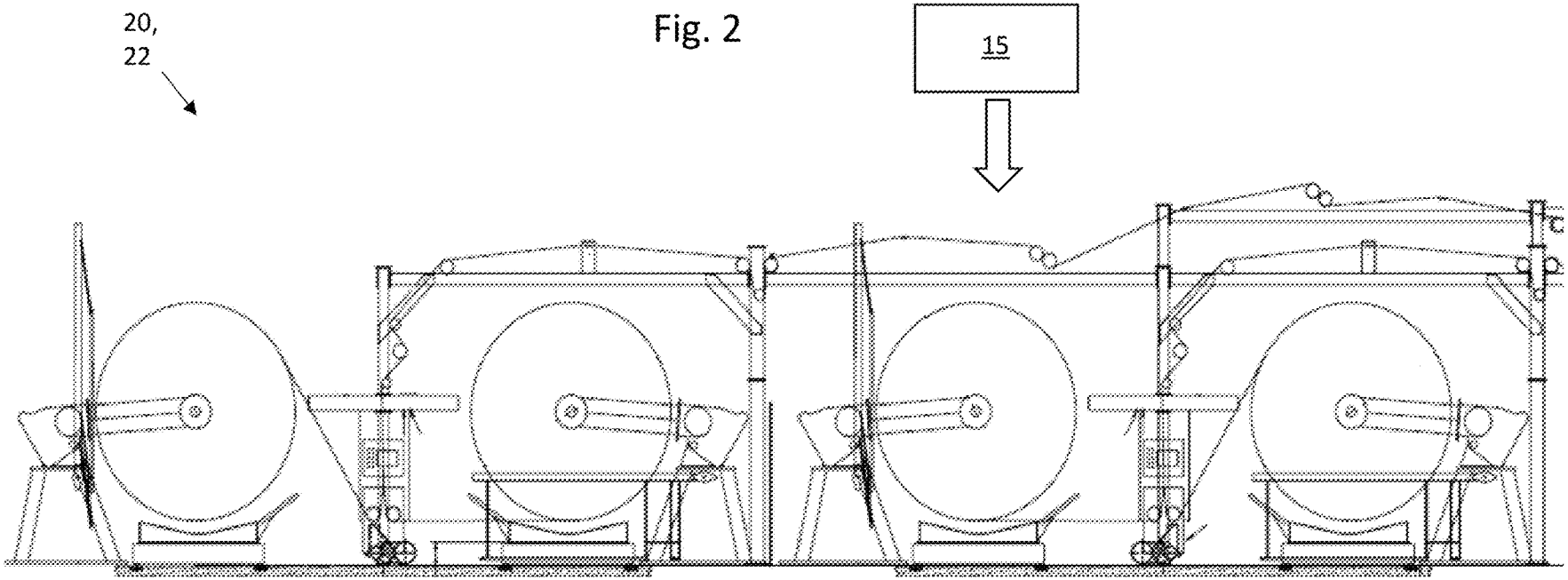
FIG. 2 is an enlarged side elevation view of the unwind station from detail area 2-2 of FIG. 1.
Figure 3:
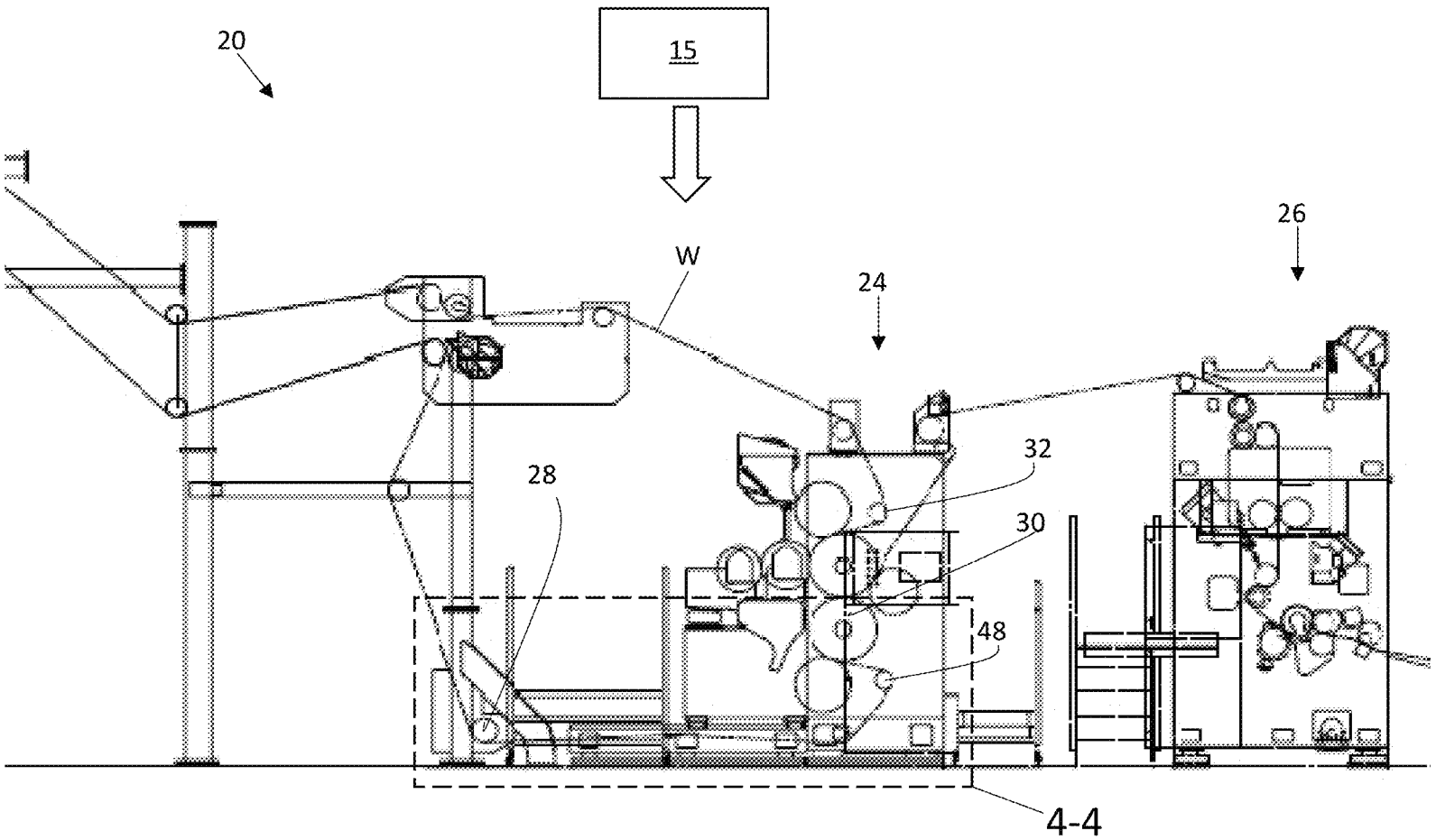
FIG. 3 is an enlarged side elevation view of the embosser-laminator and the rewinder from detail area 3-3 of FIG. 1.
Figure 4A:
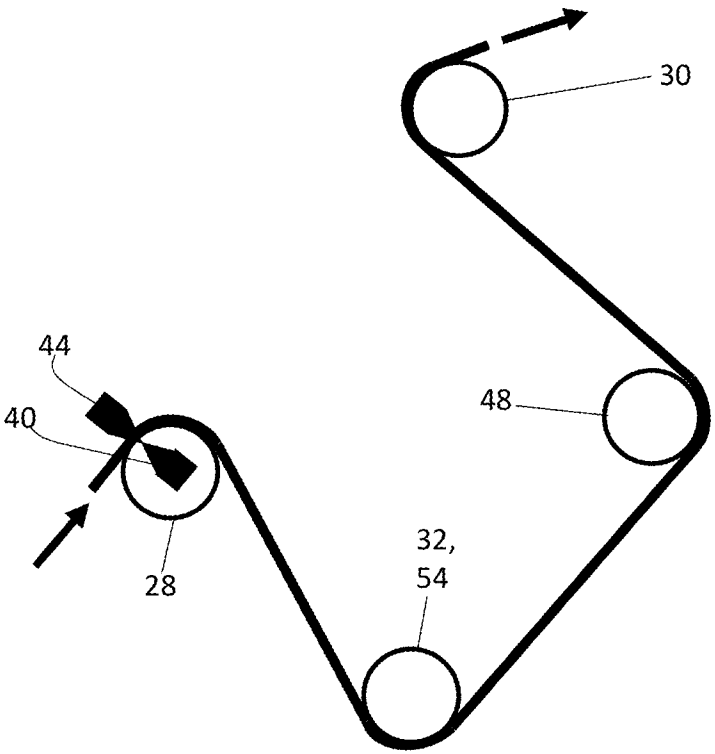
FIG. 4A is a schematic example of an implementation of the control system in which the upstream roller is a driven roller.
Figure 4B:
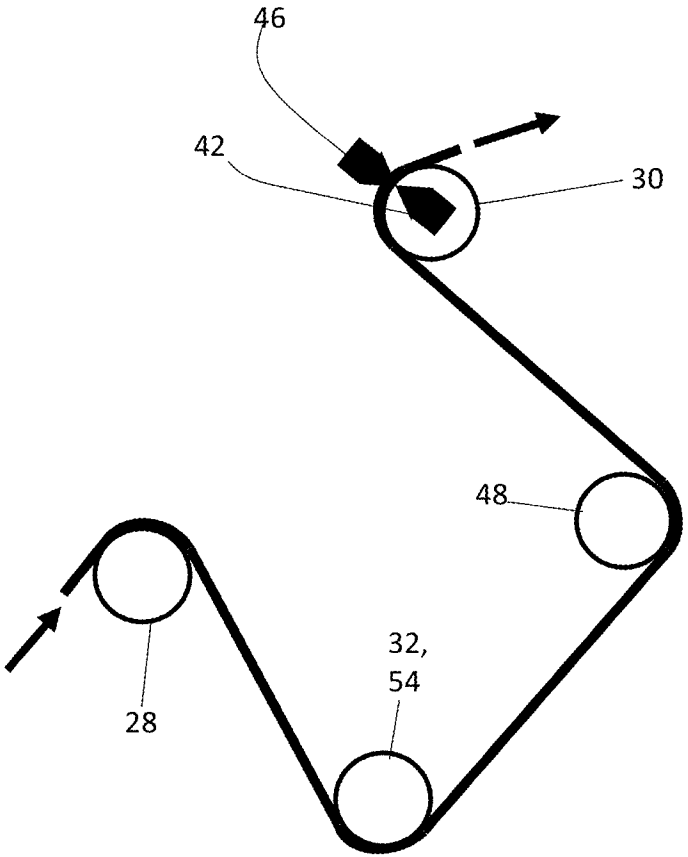
FIG. 4B is a schematic example of an implementation of the control system in which the downstream roller is a driven roller.
Figure 4C:
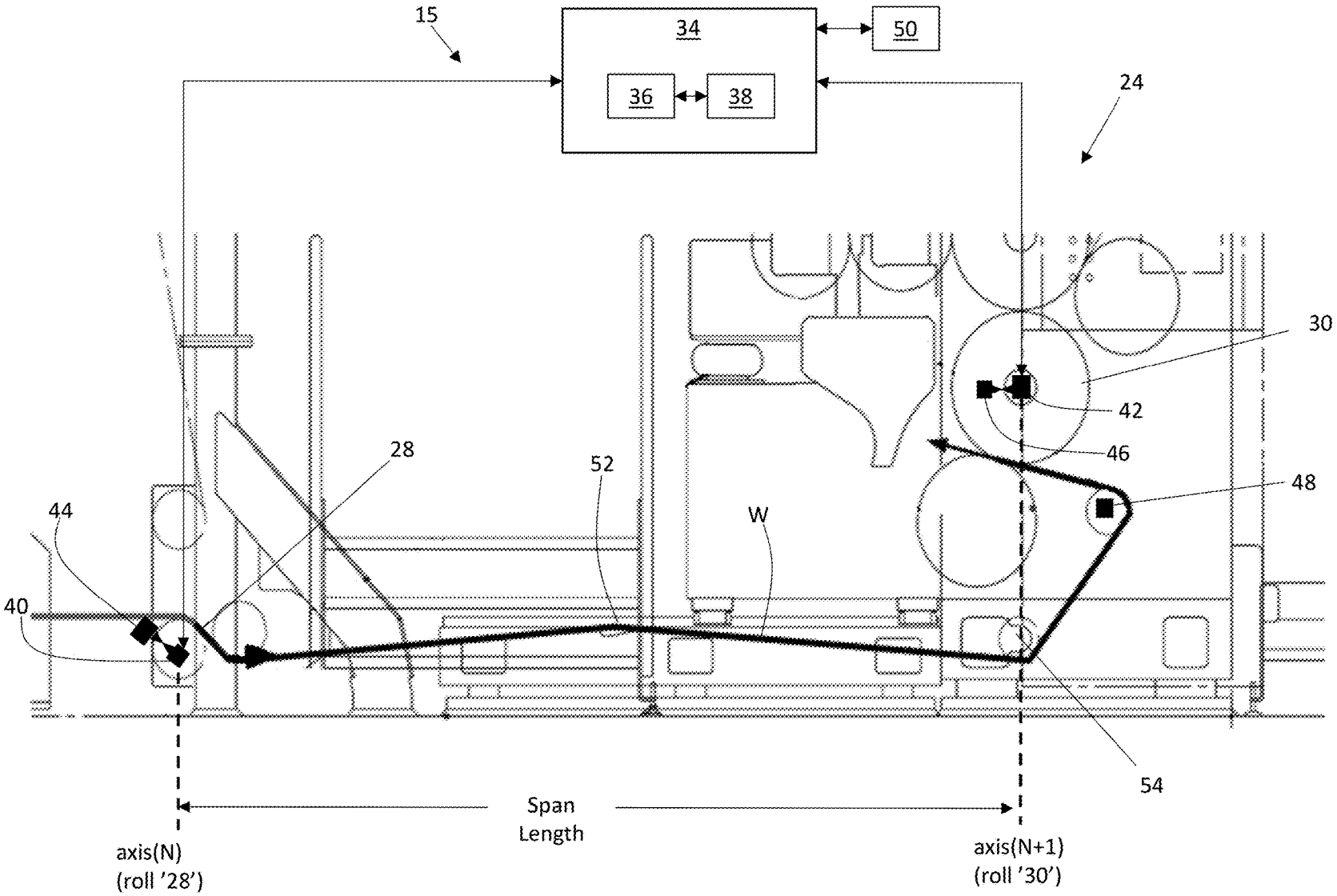
FIG. 4C is an example of an implementation of the control system in a portion of the converting line from detail area 4-4 of FIG. 3.

The control system 15 as described herein may be implemented on a converting line 20 as shown in FIGS. 1-3. By way of example, the converting line includes four unwind stations 22, an embosser laminator unit 24, and a rewinder 26 along with associated rollers 28,30,32 (others are shown but not indicated with reference characters) for directing the web through the line. The control system 15 includes a controller 34, which includes an electronic processor 36 that is communicatively coupled to a computer-readable, non-transitory memory 38. The memory 38 stores instructions that, when executed by the electronic processor 36, causes the controller 34 to provide various functionality of the control system 15, including certain functionality as described herein. The controller 34 is communicatively coupled to one or more motors/actuators 40,42 and drives 44,46 and is configured to provide a control signal to the drives and motor(s)/actuator(s) to dictate the operation of the drives and motor(s)/actuator(s). The controller 34 is also communicatively coupled to one or more sensors 48 that monitor one or more performance variables of the system being controlled by the control system. In particular the control system may be configured to use inputs from existing line hardware, for example, load cells 48 such as ABB model PFTL301E-0.1KN and roller motors 40,42, such as an Allen Bradley model VPL-B1304C-CJ12AA. The controller 34 is also configured to receive user control input from one or more user control(s) or HMI's 50. FIG. 4 provides an example of implementation of a control system 15 specifically configured for adjusting a process upstream of an embossing laminator unit 24. The control system 15 may be implemented to specifically control other locations on the converting line. Further, it should be appreciated that the control system may be installed as part of original equipment or retrofitted on existing equipment with any needed hardware.

Control System Overview

Figures 1, 5:
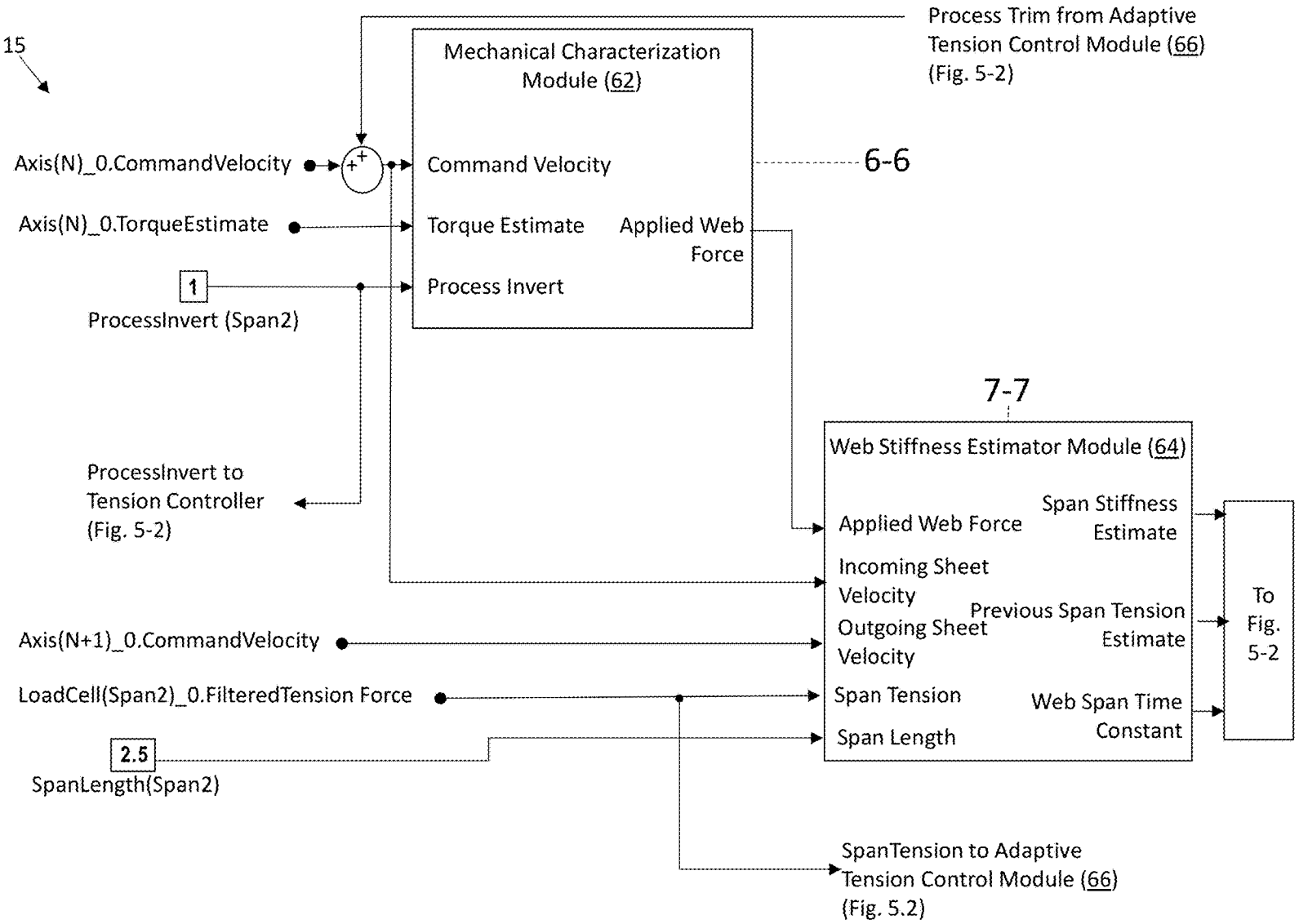
Figures 2, 5:
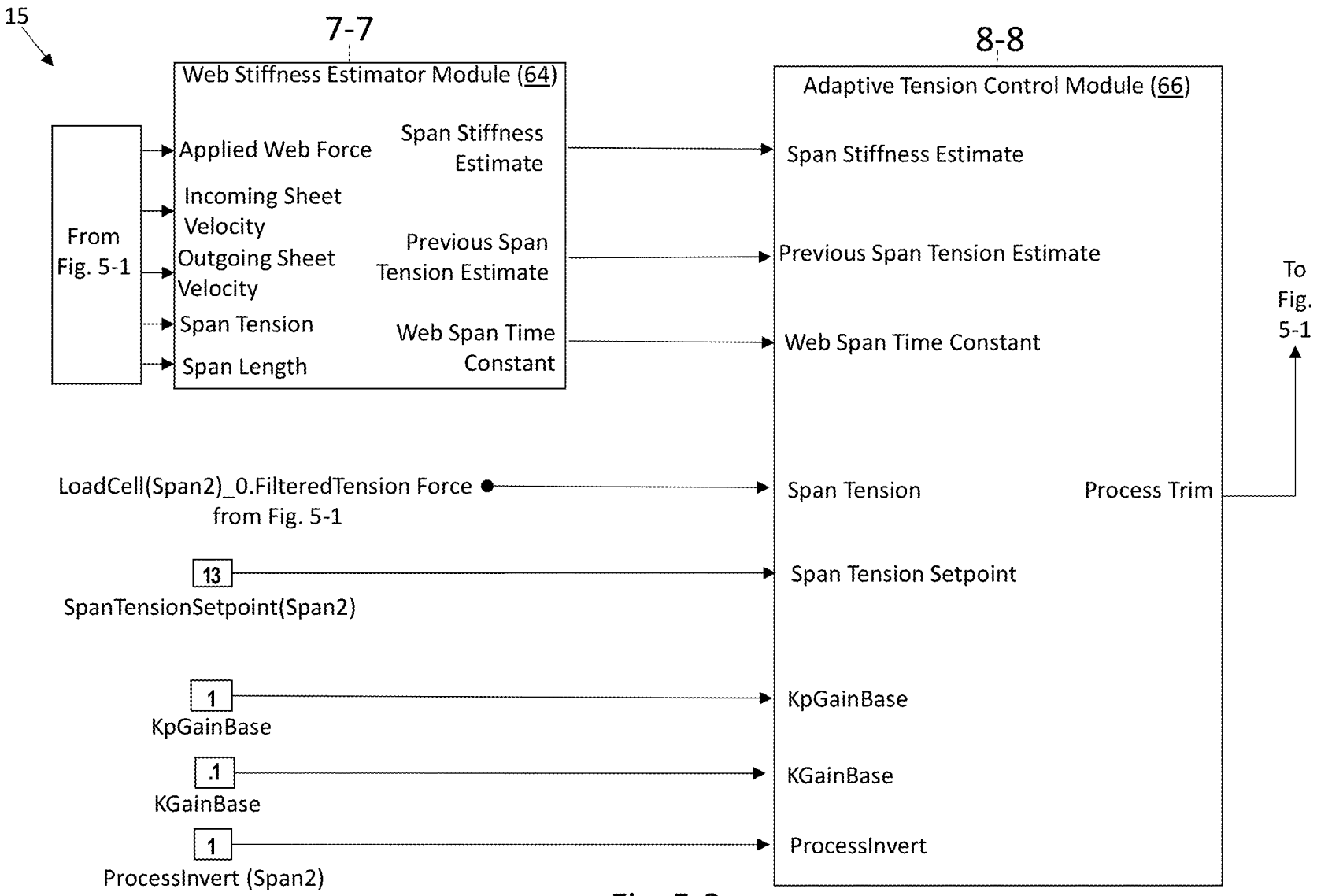
Figure 6:
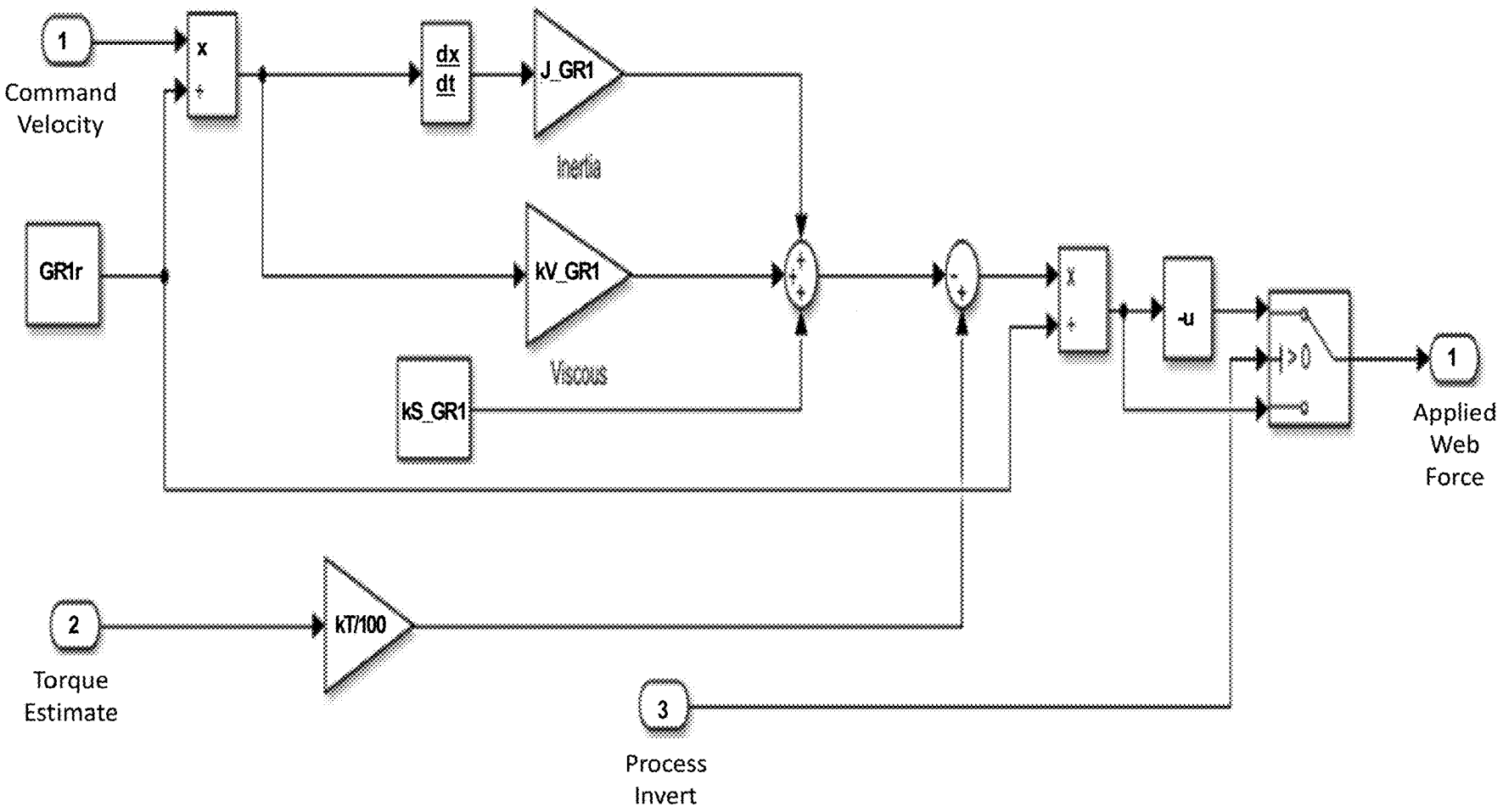
FIG. 6 is a flow diagram that provides additional detail of a mechanical characterization module of the control system from detail area 6-6 of FIG. 5-1.
Figure 7:
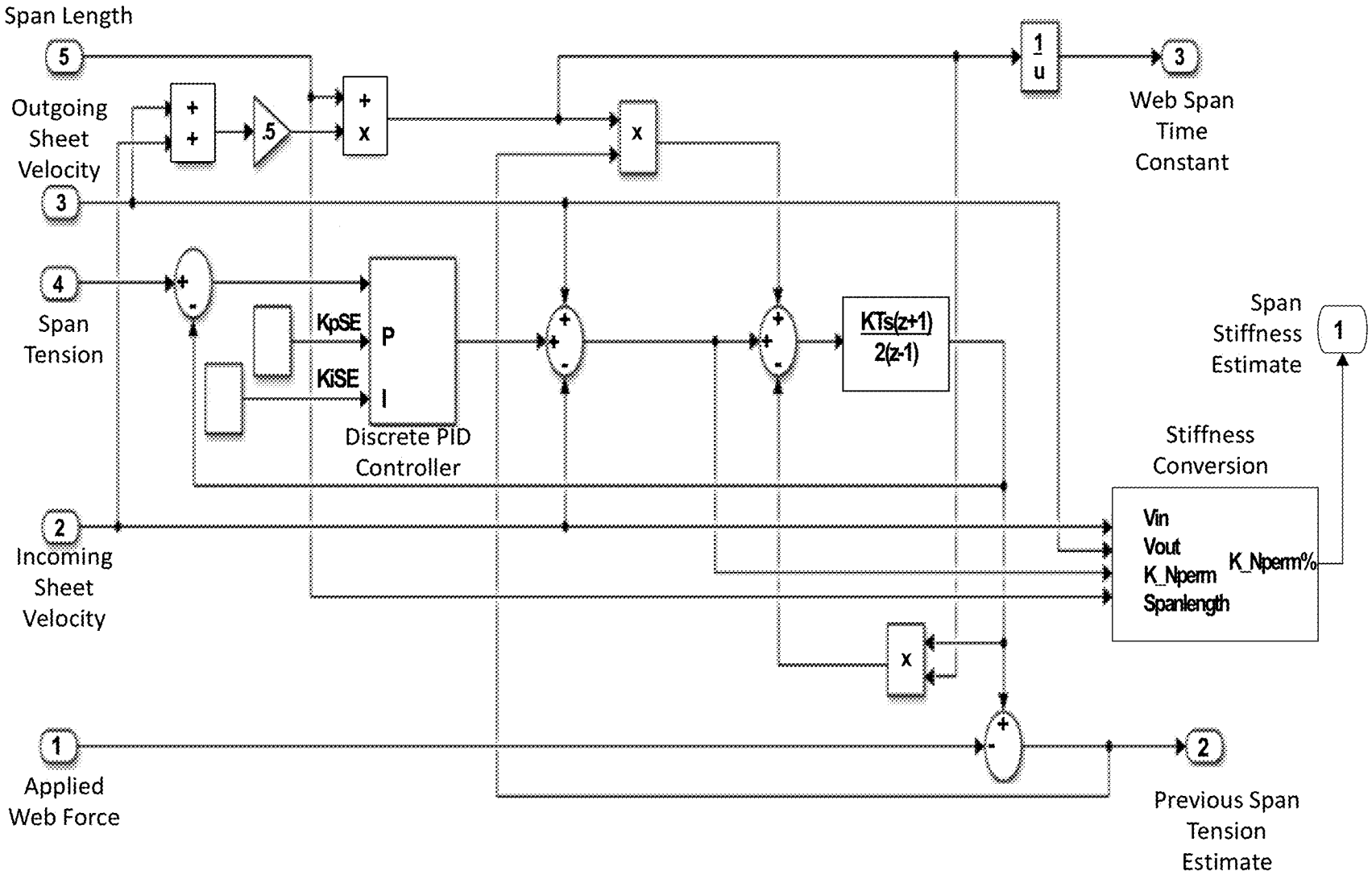
FIG. 7 is a flow diagram that provides additional detail of a web stiffness estimator module of the control system from detail area 7-7 of FIG. 5-1.
Figure 8:
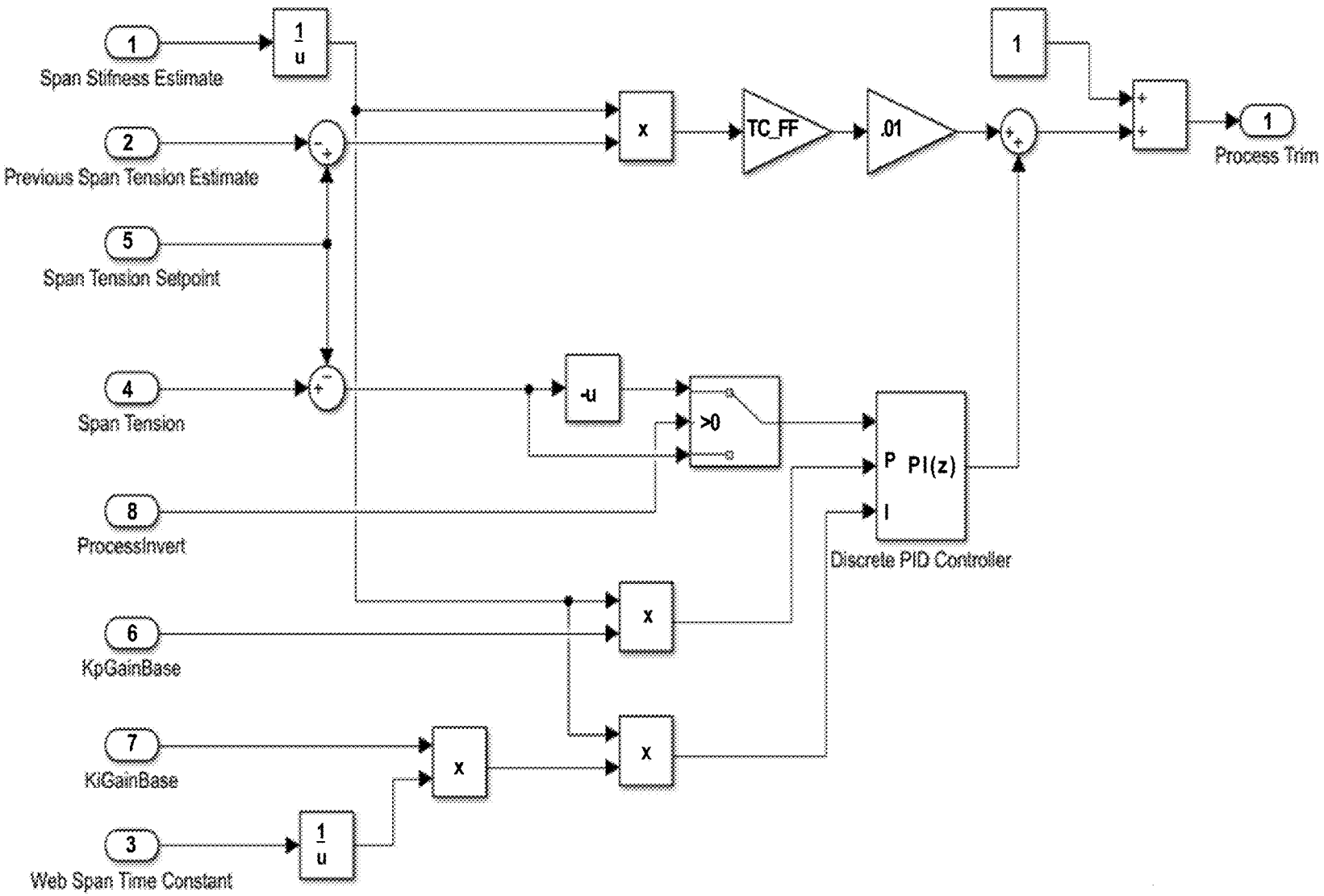
FIG. 8 is a flow diagram that provides additional detail of a tension control module of the control system from detail area 8-8 of FIG. 5-2.

FIGS. 5-1 and 5-2 provide an overview of the exemplary control system 15. The controller 34 of the control system may comprise three modules: a mechanical characterization module 62 (FIG. 6), a web stiffness estimator module 64 (FIG. 7), and an adaptive tension control module 66 (FIG. 8). The control system 15 may be configured so that the three modules 62,64,66, are applied to each roller 28,30 subject to the control system. In other words, if two rollers 28,30 are subject to the control system, the control system will be configured to apply the three module scheme to each roller.

The mechanical characterization module 62 is configured to extract losses from the mechanical system and resolve force interaction with the web W. The mechanical characterization module takes a motor torque estimate from the motor/drive system of a driven roller 28 and extracts the applied load force by removing the characteristic loss elements of the mechanical system components. The residual torque is the result of interaction with the web, that is, the remainder is the component of the torque that is the result of the web force. These parameters can be estimated dynamically on the machine or evaluated based on the system design. Ideally, the system is designed so that the friction component variability over time and with varying operating conditions is small relative to the web tension force operating regime. The parameters of characteristic loss include static/breakaway friction, viscous friction, and inertial components. The parameters of characteristic loss may be determined empirically via manual methodologies, programmatically, or purely from component specifications. To determine the above values manually, one could apply a torque trim command incrementally to the motor drive associated with the roller until motion is observed. This value would be stored as the nominal breakaway torque (kS_GR1) in FIG. 6. With this value obtained, one could then issue incremental velocity commands spaced reasonably over the operating machine speed range and capture the corresponding steady-state torque estimates for each velocity. One might choose, for example, ten points incrementing the velocity up 1.3 m/s at each point. A regression of these points for the specified axis (T_Viscous(Velocity)) can be created using data points with the formula:

$$(\text{Velocity}_{pointN}, \text{TorqueEstimate}_{pointN} - \text{kS}).$$

The next stage is resolving the contribution due to inertia during accelerations. To obtain this estimation, the axis can be ramped from a nominally low speed (0.5 m/s, for example) to a speed within the upper operating range of the axis in relation to the application (13 m/s, for example). Ideally, this ramp would contain a period of constant acceleration during which samples can be taken of the axis torque estimate, acceleration command and velocity. To estimate inertia, one can use the above-described loss components and system parameters with the formula:

$$\text{Inertia} = \frac{\text{Torque}_{Accel} - kS - \text{T_Viscous(Velocity)}}{\text{AccelerationRate}}.$$

By using incremental instantaneous values, summing and averaging, a good estimate of system inertia can be generated. An alternative to the above methodology for estimating inertia is to command a known torque and measure the effective rate of acceleration. During the acceleration, the previously determined loss components should also be fed-forward to ensure that a constant rate of acceleration is obtained. For simplicity, the effect of a non-unity transmission ratio is ignored as the reference frame is consistently at the motor; if mixing references between load and motor, it is known to those in the field that the reflected inertia of a load at the motor is inversely proportional to the square of the transmission ratio. Given the above, a teaching algorithm may be implemented to programmatically execute and characterize the axes on a machine. It would be advantageous to have this mode available for re-execution periodically as component condition is likely to change over time, for example, a period of months. Older results could be used as benchmarks with variance thresholds flagging potential abnormalities on the machine described. The newest results can be used to keep the controller operating optimally. Once these loss components are known, the force interaction of the web on the roller can be estimated by subtracting the losses from the torque estimate and multiplying by the radius of the driven roller 28.

The signal representative of the electromagnetic torque applied to the motor of a driven roller 28 is ideally a signal that is filtered of high frequency artifacts inherent in servo drive control (cogging artifacts, noise, switching noise, etc.). The signal also is ideally confirmed to offer an accuracy relative to the application that makes torque estimation errors relatively small. A technology such as Rockwell Automation's Virtual Torque Sensor (VTS) technology meets this requirement when applied to an appropriately sized motor given the operating ranges of a machine.

The other input to the mechanical characterization module 62 may include a web velocity reference which may be generated by motor 40 associated with the driven roller 28 and considered the incoming web velocity, which may be assumed to be a nominal web velocity such that there is no slip between the web and the driven roller.

The web stiffness estimator module 64 receives inputs of elements of a web span described as the length of web between axis(N) of an upstream driven roller 28 and axis (N+1) of the next successive or downstream roller 30, a web velocity reference which may be generated by motor 40 associated with the upstream driven roller 28 and considered the incoming web velocity, a web velocity reference which may be generated by motor 42 associated with a successive or downstream roller 30 and considered the outgoing web velocity, a load cell 48 or other means of measuring stress or tension in the web, and the applied web force signal generated as a result of the mechanical characterization module 62.

For ease of illustration in the discussion that follows, and not in any limiting sense, a two driven roller span as shown in FIG. 4 will be discussed. Although in the discussion that follows both the upstream and downstream rollers 28,30 are driven rollers, it is not necessary that both are driven rollers as the system may be implemented with either an upstream roller or a downstream roller that is an idler roller provided with a means of providing a web velocity reference, such as an encoder or a surface velocity sensor such as a Sick SpeeTec sensor. It is assumed that proper web wrap, non-zero web strain, and roller surface characteristics are such that there is no slip between the web and the respective roller. For each span, the incoming and outgoing web velocities may be the surface velocities of the respective rollers. Axis(N) and Axis(N+1) in a given span may comprise driven guide rollers, idling guide rollers with means of providing a web velocity reference, driven embossing rollers, and driven draw rollers. In the example shown in FIG. 4, Axis(N) is a driven guide roller 28 while Axis(N+1) is a driven steel embossing roller 30 in an embossing laminator unit 24. A span may also comprise one or more air foils 52 and/or one or more spreader rolls 54, as in the example shown in FIG. 4. The span length is considered to be the length of web between Axis(N) and Axis(N+1). The tension of the web is known from the web force measurement based on a load cell 48, and an estimate of the web force interaction of the one of the rollers is known from the mechanical characterization module for the specified roller 28.

With this information, a model reference approach is taken to estimating the web stiffness. The web stiffness estimator module 64, shown in FIG. 7 works by using a PI controller to evolve the stiffness estimate from an initial value (for example, zero, or preferably a typical value based on the classification of web such as 40 N/% for TAD towel, 15 N/% for TAD bath tissue, etc.) such that the measured tension in the span is equal to the incoming tension estimate summed with the stiffness estimate multiplied by the span strain. The span strain is resolved based on the difference of incoming and outgoing web velocities. The incoming tension estimate is derived by leveraging the relationship of the measured web tension (for example, from a load cell 48) and the force applied to the web by the upstream roller 28 based upon the mechanical characterization module 62 for the upstream roller. The "AppliedWebForce" is effectively the tangential force of the guide roller evaluated acting on the web.

$$\hat{T}_{Span(x-1)} = \text{AppliedWebForce}_{Axis(n)} + \text{MeasuredSpanTension}_{Span(x)}$$

$$\hat{k}_{Span(x)} = \left( \frac{\text{MeasuredSpanTension}_{Span(x)} - \hat{T}_{Span(x-1)}}{\text{Axis}(N+1)_\text{O.CommandVelocity} - \frac{\text{Axis}(N)_\text{O.CommandVelocity}}{\text{Axis}(N)_\text{O.CommandVelocity}}} \right) \cdot 100$$

The stiffness estimate is normalized as Newtons of force per percent of web strain as shown below:

$$\left( \frac{N}{1\%\ \text{strain}} \right).$$

It should be clear, that if an implementation of the above is subject to significant web width variation, the stiffness estimate could be normalized to include a dimension of width. With an estimate of the web stiffness, the system now has a relationship to how the differential in roller speeds in web spans will influence effective web stress (web tension). The results can be used to optimize the tension control module.

A conventional web tension controller operates utilizing a PI(D) control law. The error signal is generated based on the difference between the measured and setpoint web tension values. A proportional, integral, and sometimes derivative control are then applied to this error signal with gains. Conventionally, these gains are static, set by a product classification, or stored in a recipe system to be recalled with a product or product classification. This presents numerous challenges. First, it is very common for a single converting line to run many different product grades with vastly different base web properties. Even within a single product, the base web characteristics are constantly evolving to target consumer feedback, cost targets, paper machine component wear, raw material (pulp) variation, and other constraints. Expounding on this, it is common for web properties to vary significantly within a given parent roll of the same base web due to the effects of the reel rewinding process. The plethora of sources for base web differences make non-adaptive methodologies for controlling web tension suboptimal.

The adaptive tension control module 66 (FIG. 8) applies the previously estimated parameters to provide a means to scale the control loop response to the expected behavior of the process. First, a feedforward path is provided. The previous (upstream) span tension estimate, and the desired span tension setpoint can be used to generate a net desired change to tension in the span ($\Delta_{Tension(SpanX)}$). With the desired tension differential and stiffness estimate, the required estimated velocity differential required to achieve the change in tension can be directly inferred as $$\frac{\Delta_{TensionSpan(x)}}{\hat{k}_{Span(x)}}.$$

Given this estimated value and a feedforward gain (TC_FF), the signal is summed with the output of the tension control PID regulator. The advantage of the feedforward path is that it provides a significant portion of the control signal outside of the inherent lag of the PID controller. It also reduces the net control effort of the PID controller.

Given a PI regulator controls the speed difference of two rollers controlling the web, the web stiffness estimate can be used to scale the controller bandwidth (normalize controller gains) to provide a comparable response as web stiffness changes. A simple assumption can be made that the loop is pre-armed with nominally tuned values for a physical section of a machine and a given web stiffness. Given a current web stiffness, the gains can be scaled proportionately to maintain stability and consistent loop response.

Other Uses of the Control System

Another useful application of being able to estimate the web stiffness would be to estimate a relative tension change in the series of adjacent web spans between directly measured spans having rollers subject to the control system. In this sense, if one knows the incoming and outgoing web velocities of a span and the stiffness, a relative tension change can be estimated using the equation:

$$\hat{k} \frac{\text{Axis}(N)_\text{O.CommandVelocity} - \text{Axis}(N-1)_\text{O.CommandVelocity}}{\text{Axis}(N-1)_\text{O.CommandVelocity}} \cdot 100 = \Delta\hat{T}_{Span(x-2)}.$$

In this equation, the web is moving in the machine direction from Axis(N−1) towards Axis(N), $\hat{k}$ is the web stiffness estimate, and $\Delta\hat{T}$ is the estimate of the differential tension of that span. Expanding on this concept, because the web stiffness estimator provides a tension estimate of the adjacent span, one can propagate an absolute tension estimate working backwards or forwards from the span with the web stiffness estimator. Expanding on the two roller span arrangement shown in FIG. 4, the stiffness estimate can be applied to the upstream spans back towards the unwind station by backpropagating tension estimates using the formula below where $\hat{T}$ is the estimate of the tension in the span denoted:

$$\hat{T}_{Span(x-2)} = \hat{T}_{Span(x-1)} + \hat{k} \frac{\text{Axis}(N)_\text{O.CommandVelocity} - \text{Axis}(N-1)_\text{O.CommandVelocity}}{\text{Axis}(N-1)_\text{O.CommandVelocity}} \cdot 100$$

Or more compactly substituting $\Delta\hat{T}_{Span(x-2)}$:

$$\hat{T}_{Span(x-2)} = \hat{T}_{Span(x-1)} + \Delta\hat{T}_{Span(x-2)}$$

Estimating web stiffness in this manner could be advantageous to apply not only pre-transformation (embossing, laminating, coating, etc.) but also post-transformation to understand the imposed change to the properties of the web or webs.

Further expanding on the use of these derived insights, useful diagnostic information can be inferred. For example, while back or forward propagating the estimates described above, if there is another span with rollers subject to the control system, it would be reasonable to compare the estimate of that span tension against the actual measured (load cell) or imposed tension (dancer). Once a threshold of equivalence is determined based on the nominal operating performance of the system, enunciation of deviation could indicate improperly performing components that may include at least the driven roller motors, motor to roller couplings, roller bearings, load cell or dancer function or calibration, or the overall system losses may need to be recalibrated.

Another insight of operation can be understood by directly evaluating the relationship of a span's $\Delta\hat{T}$ against the referenced driven roller motor torque as it relates to the expected value for the required force applied to the web. In the example above, one would expect that, nominally, $\Delta\hat{T}=\text{ForceWeb}_{Axis(N-2)}$.

Further Uses and Advantages

The combination of core diameter (or hole diameter, in the case of coreless products), log diameter, product length, and paper caliper define how tightly or loosely a roll is wound. Theoretical wound caliper (Equation 1) provides a mathematical answer to the question: "If a roll was to be wound with a perfectly uniform winding profile and no compression of the web, how thick would the web need to be?"

Equation 1: Theoretical Wound Caliper $$\text{caliper}_{wound} = \frac{\pi}{4} \cdot \left( \frac{OD_{roll}^2 - OD_{core}^2}{\text{length}_{product}} \right)$$

Wind tightness can be calculated as wound-in compression, or how much thinner a web becomes after winding relative to its measured caliper before winding, when a given length is wound to a given roll diameter with a given core/hole diameter. It can also be calculated as caliper fill. Wound-in compression and caliper fill are typically reported in terms of percent (Equations 2-4).

Equations 2-4: Caliper Fill and Wound-In Compression $$\text{CaliperFill} = \frac{\text{ConvertedCaliper}}{\text{WoundCaliper}}$$

$$\text{CaliperFill} = \frac{1}{1 - \text{CaliperCompression}}$$

-continued $$\text{WoundInCompression} = \frac{\text{ConvertedCaliper} - \text{WoundCaliper}}{\text{ConvertedCaliper}}$$

$$\text{WoundInCompression} = 1 - \frac{1}{\text{CaliperFill}}$$

Figure 9:
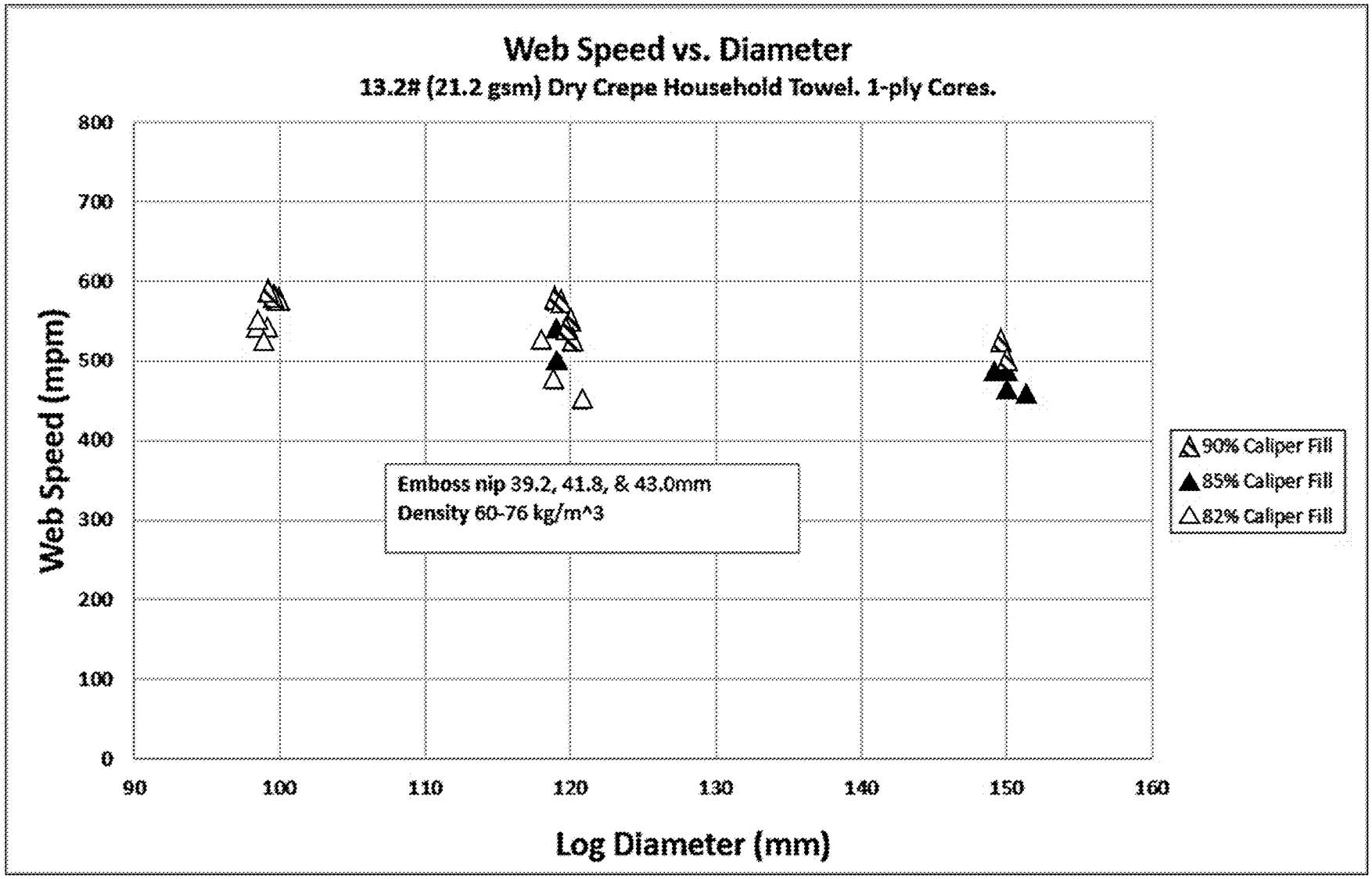
FIG. 9 is a scatter plot showing a representation of typical processing parameters of web speed and diameter for typical caliper fills for a grade of dry crepe household towel.
Figure 10:
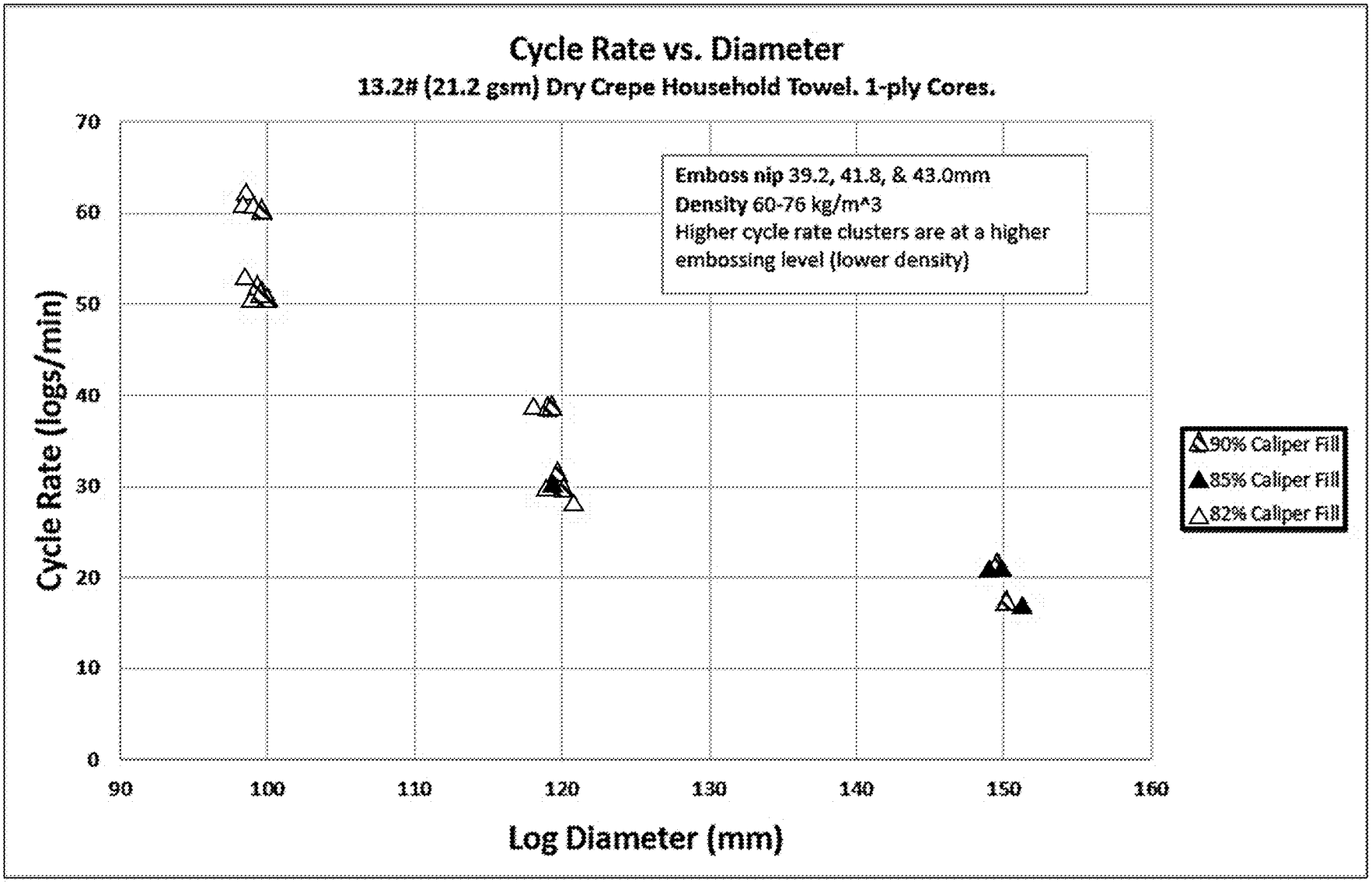
FIG. 10 is a scatter plot showing a representation of typical processing parameters of cycle rate and diameter and caliper fills for a grade of dry crepe household towel.

Caliper fill presents the data from roll's perspective, while wound-in compression presents the same data from the web's perspective. The relationship between theoretical wound caliper and actual measured caliper has also been expressed as a "compression ratio"; any of the three among caliper fill, wound-in compression, and compression ratio can be calculated when one of them is known. Different paper grades may have different ranges of desirable wound-in compression, and the ranges may be different for tissue and towel, from the standpoint of sustainable production speeds and rates. FIG. 9 shows an example of rewinder speed vs. log diameter and caliper fill for a selection of household towel products produced with one grade of towel, while FIG. 10 shows an example of rewinder cycle rate for these same products. Different product types may have different ranges of desirable wound-in compression from the consumer standpoint—a roll that is neither too mushy nor too firm for the consumer's perceived quality. The loftier and bulkier the web, the wider the operating window of wound-in compression may be. The less lofty and bulky (i.e. the more similar it is to wax paper or cardboard), the narrower the operating window of wound-in compression may be. If parent rolls have caliper drop-off (a reduction in caliper), for example, near a splice within a parent roll or as the end of a parent roll near its core is approached, it may make sense to design the roll products to have a target wound-in compression at the high end of the desirable wound-in compression range in order to allow for some degree of caliper drop-off.

If log diameter, sheet length, and sheet count remain unchanged as a parent roll is unwound (obviously core or hole diameter remains constant as a parent roll is unwound), and the caliper of the paper changes, the caliper fill and the wound-in caliper compression of the log will change. If the caliper decreases significantly, the rewinder may not be able to produce a log at the target diameter, instead producing an undersized log diameter. Or, if log diameter is maintained, the log will have a lower wound-in compression and be more compressible, which may not be desirable for the downstream cutting and packaging equipment in a roll converting plant, and/or may be unacceptable for the consumer. Varying web caliper may be measured. Varying web caliper may be inferred from varying log properties: for example, if two logs have the same diameter, sheet length, and sheet count, and were produced with the same converting line settings, but one is more compressible (i.e., is less firm, or more mushy), the more compressible log was likely produced when the parent roll caliper was thinner. A known solution when web caliper gets thinner is to add sheets to the roll (known in the tissue industry as over-sheeting) and/or reduce the web speed, which may not be economical. Other methods may be employed to retain the target log diameter, such as reducing the web tension, reducing the speed of the lower roll of a surface rewinder, or reducing the rotational speed of a core end engagement assembly in a surface rewinder.

The control system as disclosed herein provides for improvements to known methods for compensating for caliper loss. Known methods provide for adding a fixed number of sheets at a fixed parent roll diameter, or reducing web speed by a fixed amount at a fixed parent roll diameter, or adjusting wind nest settings at a fixed parent roll diameter. At best, known methods may provide for adjustments at multiple steps of parent roll diameters. The parent roll diameters are typically set at diameter levels where the preponderance of parent rolls are known to have sufficient properties for a consistent production process. The control system disclosed herein allows for the number of sheets and/or the speed and/or the wind nest settings to be adjusted in continuous (analog) fashion, and only if and to the extent the data dictates. The control system disclosed herein also provides benefits beyond known methods of feeding parent roll paper physical property data to the converting line: whereas in known methods the paper property data is typically measured only at the outside of the parent roll, the invention allows for some paper properties to be continuously adjusted for throughout the parent roll.

Another property that may deteriorate throughout a parent roll is stretch. Stretch may be lower near the parent roll's core than it is near the outside of the parent roll. Stretch may also change as a result of web transformation processes such as embossing, laminating, coating, etc. Stretch loss may cause problems in the web entering the embossing nip of an embossing laminator. In an embosser-laminator, glue is applied to the embossed paper, typically on the upper ply, while the paper is on the embossing elements. If, as the stretch decreases, the tension in the web entering the embossing nip is not changed, the tension setpoint may no longer be sufficient to keep the web on the embossing elements of the steel engraved roll. If the web comes off of the embossing elements, forming what is sometimes referred to as a bubble, the glue that was applied is no longer in register with the embossing pattern when the paper enters the marrying roll nip, and a lamination bond fails to form. If, on the other hand, the tension setpoint in the web entering the nip is set sufficiently high so that, even if stretch is lost, the web remains on the elements of the steel engraved roll, the high tension may have other adverse effects such as a reduction in web caliper. The reduction in web caliper due to increased tension may be especially adverse in grades with a low yield strength, which when once stretched beyond their yield point do not spring back to their unstretched state. The invention disclosed herein provides for tension in the web entering the embossing nip to be adjusted based on the continuously monitored web properties: as stretch decreases, tension can be increased, and when stretch increases (for example when a new parent roll is loaded into the line) tension may be decreased. This approach may be further improved if UV dye is added to the lamination adhesive, and an image from a blacklight is monitored for indications of loss of registration between the applied adhesive and the embossing elements.

It is known that there are tradeoffs among embossing level, paper caliper, tensile strength, and absorption. Increasing embossing pressure increases caliper but degrades tensile strength. These tradeoffs are generally more applicable to conventional dry crepe tissue grades than to structured grades such as through-air dried (TAD). With TAD, the goal of embossing is typically to decorate the product while preserving the caliper and absorbency already present in the base paper. In the case of some household towel products, increasing embossing pressure may increase both caliper and absorption. Increasing embossing pressure may increase caliper and/or absorption to a point, beyond which the tensile strength is too degraded for the product to be useful to consumers. Caliper transformation is a comparison of the combined caliper of the incoming plies with the finished caliper. If, as in prior art, the converting line merely closes the loop on caliper by increasing embossing pressure in response to a decreasing caliper, the resulting product may have a tensile strength below an acceptable minimum. The control system as disclosed herein provides for continuous monitoring of caliper transformation which, when combined with continuous monitoring of paper properties, provides for intelligent automatic adjustment of the appropriate combination of web speed, embossing level, number of sheets, and/or rewinder parameters. The caliper transformation measurements and calculations are relative: as is known in the tissue industry, to get an accurate absolute measurement of caliper, the caliper of a stack of several sheets, for example 5-10 sheets, is measured and divided by the number of sheets in the stack.

Known methods of caliper control, such as increasing embossing pressure as paper caliper decreases, may be improved by monitoring rubber embossing roll temperatures, and either providing feedback to the operator or automatically changing a converting line process parameter, if rubber embossing roll temperature exceeds a threshold value. Such an approach may prevent the failures of rubber covers on rubber embossing rolls. For example, two heat-sensing cameras may be provided on each roll. Known methods of caliper compensation, such as automatically adding sheets to a roll when paper caliper decreases, may be improved by correlating with other sensor feedback. For example, log vibration in the rewinder wind nest may be detected by accelerometers mounted to center drives. Log vibration in the rewinder wind nest may be sensed in accordance with the principles described in U.S. Pat. No. 11,261,045. Known and improved methods of parent roll property compensation and paper caliper control may be combined for a further enhanced control. For example, as paper caliper decreases, an embossing pressure may be increased, but only to the point of diminishing returns on caliper increase, and only if rubber roll temperature remains below a threshold level; if a further decrease in caliper occurs, sheets may be added to the product and/or the web speed may be reduced.

Viscoelastic properties of webs may cause problems even if they do not vary throughout a parent roll if the impact of the property varies with speed. When a parent roll expires and a new one begins, the old and the new webs are spliced together with tape, glue, or mechanical bonding. The line speed is typically slowed down to allow the spliced joint to reliably travel through the web handling system, until the joint is wound into the log. At high web speed, the viscoelastic effects may be of a time scale that their impact is negligible, while at low speed, viscoelastic effects may be more pronounced. The control system as disclosed herein provides data that can be used to compensate for some such viscoelastic effects.

One such property that has immediate effects on the converting process is stress relaxation. In converting, web is conveyed some distance from the parent roll to the rewinder depending on needs for the line configuration. With variable machine speed, the amount of time the web spends in transit varies. It is known that the web is under some state of stress as it is processed (web tension). For example, starting at the unwind with a set tension, the effect of stress relaxation means that that downstream tension, embosser infeed as one example, may be less than the tension at the unwind due to stress relaxation. It may become impossible to convey the web and maintain a tension at a low speed that is optimum at high speed. If this property is not accounted for, the result can be excessive web strain and web breaks when the machine runs at lower operating speeds.

Because the control system described herein provides a method to estimate the boundary tension in a multiple roller system and the effective stiffness at operating speed, stress relaxation can be adapted for by observing non-linearities in the web stiffness estimate at low speed. As previously discussed, the deviation from the expected relationship of the propagated tension estimates versus an in-line span with a known tension can be indicative of this effect.

It should also be clear that by evaluating the web stiffness estimate at different speeds that one can generate a regression to relate strain rate and web stiffness. This can then be used in the context of the above discussed embossing process. The initial process was described in the linear elastic context, but when adding the viscoelastic properties of the web, this simplification can result in process disruptions as operating speeds change. With knowledge of the web stiffness, different operating setpoints can be more easily adapted. One exemplary implementation could include relating critical operating embosser setpoints such as incoming web tension, nip width, emboss pattern top area, normalized pattern element perimeter, and machine speed to determine peak embossing process stress. This would be helpful in idealizing operating bounds for the input parameters to maintain a stable and reliable process: for example, but not limited to, limiting the maximum emboss nip width for a maximum expected operating speed or generating a maximum recommended speed given a required nip width.

Another aspect of converting that may vary with speed is marrying roll pressure. Multi-ply laminated bath tissue and towel products typically use marrying roll pressure to set the adhesive bond between the plies. High process speeds may require higher marrying roll nip pressure than lower speeds. When operating at lower speeds less nip pressure is required to achieve bonding. High nip pressure at low speed may cause the adhesive to bleed through the webs and build up on the roll surfaces. The build-up may lead to downtime for roll wraps and manual roll cleaning. By applying nip pressure proportional to web speed, the process may be optimized to maximize bonding at higher speeds while minimizing the adhesive bleed-through at lower speeds.

The control system as described herein simplifies human interaction with the converting line. It simplifies initial commissioning of the line on a first paper grade, commissioning additional grades, and changing between paper grades. It simplifies an operator's daily interaction with the line, and a maintenance technician's periodic interaction. The self-adapting optimized tension control eliminates the need to tune PI loops around different web characteristics, and reduces the time required to determine centerlines for new roll products. Because the control system adapts and adjusts, the number of adjustments remaining for an operator to make is reduced. It allows for remaining adjustments to be more intuitive: instead of expecting operators to conceptualize the impact of velocity differentials between driven web elements and tensions of closed loop portions, a holistic tighter/looser interaction may be used and the system may evaluate operable bounds of the system automatically. The control system identifies the highest probability web break initiation point using all available sensors (load cells, motor feedback, photoeyes/cameras) as a system. By the nature of the system, the web handling elements have the ability to detect an abnormal state. This allows for predictive failure diagnosis: for example, a load cell is not behaving properly, or feedback from a guide roller is abnormal due to slipping or not driving the web. The control model may also track changing system behavior such that the velocity of change of a tracked parameter could signal hardware issues. Human interaction with the converting line may be further simplified by providing a vision system to monitor the applicator roll (also known as distributor roll, or cliché roll) for consistent adhesive distribution across the applicator roll, which is typically monitored by regular inspection by an operator.

The control system as disclosed herein may be enhanced by incorporating insights from a larger data set. This data may be written to a memory, for example a radio frequency identification device (RFID) associated with a parent roll, and read by a sensor at the converting line. For example, for paper grades whose properties degrade over time, the date of manufacture of the parent roll(s) could be used as an indication that a change in a converting line process setting may be needed. This change may be determined empirically (for example a reduced speed for older paper that has been observed by operators to be sustainable) or by correlating the parent roll data over time to converting line overall equipment effectiveness (OEE) data. For example, converting line OEE may be correlated to paper machine creping blade cumulative run time. For example, converting line OEE may be correlated to paper machine creping blade angle. For example, converting line OEE may be correlated to paper machine clothing cumulative run time. For example, converting line OEE may be correlated to pulp furnish characteristics. For example, a packaging system OEE may be correlated to parent roll diameter at which a roll was produced. For example, the position of the paper machine reel spool when the parent roll is winding, and the force on the reel spool, may be used to infer paper caliper and stretch, based on comparing the reel spool's actual position to the reel spool's predicted location based on parent roll diameter.

One way to divide the tissue industry is between integrated tissue mills and contract converters. An integrated tissue mill both produces parent rolls and converts them, while contract converters either buy parent rolls on the open market or are supplied with parent rolls from their customer. The control system as disclosed herein may be especially useful for contract converters. An integrated tissue mill can experience varying paper properties throughout a parent roll, and from parent roll to parent roll, but an integrated mill has a higher level of control than does a contract converter. An integrated tissue mill can run parent rolls in the order in which they were produced, to maximize the extent to which paper properties vary gradually as raw materials (for example, pulp) vary and/or as paper machine components (for example, fabrics and creping blades) wear. An integrated tissue mill can run parent rolls "hot" from the paper machine, i.e. soon after they were produced. Contract converters have much fewer such strategies available than does an integrated tissue mill. A contract converter's supply of parent rolls for a given product may come from different paper machines and/or different tissue mills. In current state, contract converters typically have access to only the data printed on the parent roll tag and/or certificate of analysis. Accordingly, the control system as disclosed herein may be particularly useful for a contract converter as it is more operator friendly, easier to use, and capable of supporting consistent production with webs of varying and changing properties.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A control system for a converting line, wherein the converting line has an upstream roller and a downstream roller downstream from the upstream roller, the upstream roller and downstream roller being adapted to direct web material through the converting line along a span defined by the upstream roller and the downstream roller, at least one of the upstream roller and downstream roller comprising a driven roller, the control system comprising:

a drive for driven roller, the drive being adapted and configured for controlling the driven roller;

a torque sensor for the drive of the driven roller, the torque sensor of the driven roller being adapted and configured to generate a torque signal representative of a torque associated with the driven roller;

a tension sensor for sensing tension of the web in the span;

a velocity sensor for the upstream roller, the velocity sensor of the upstream roller being adapted and configured to generate a velocity signal representative of a velocity of the web material at the upstream roller;

a velocity sensor for the downstream roller, the velocity sensor of the downstream roller being adapted and configured to generate a velocity signal representative of a velocity of the web material at the downstream roller; and a controller of the control system, the controller of the control system comprising a processor and a memory coupled with the processor, wherein the memory is configured to store instructions that, when executed by the processor, cause the processor to:

(a) within a mechanical characterization module of the controller associated with the driven roller:

(i) receive the velocity signal from the driven roller and receive the torque signal from the torque sensor associated with the drive of the driven roller, and (ii) based upon parameters representative of mechanical properties associated with the driven roller, generate a signal representative of an estimate of an applied web force at the driven roller;

(b) within a web stiffness estimator module of the controller associated with the driven roller:

(i) receive the signal representative of the estimate of the applied web force from the mechanical characterization module;

(ii) receive the span tension signal from the span tension sensor;

(iii) receive the velocity signal from the upstream roller sensor;

(iv) receive the velocity signal from the downstream roller sensor; and (v) based upon the span length, the velocity signal from the upstream roller sensor, the velocity signal from the downstream roller sensor, the span tension signal from the span tension sensor, and the signal representative of the estimate of the applied web force from the mechanical characterization module, generate a signal representative of an estimate of a span stiffness, a signal representative of a tension estimate in a previous span of the web prior to the upstream roller, and a signal representative of a span time constant; and (c) within a tension control module of the controller associated with the driven roller:

(i) receive the signal representative of the estimate of the span stiffness from the web stiffness estimator;

(ii) receive the signal representative of the previous span tension estimate from the web stiffness estimator;

(iii) receive the web span time constant from the web stiffness estimator;

(iv) receive the span tension signal from the span tension sensor; and (v) based at least in part upon the signal representative of the estimate of the span stiffness, the signal representative of the previous span tension estimate, the web span time constant, the span tension signal, and a span tension setpoint, generate a velocity trim command signal for the drive of the driven roller.

2. The control system of claim 1 wherein the controller is adapted and configured such that the instructions stored in memory, when executed by the processor, cause the processor to, within the web stiffness estimate module of the controller for the driven roller, generate the previous span tension signal in the span without direct web tension feedback within the previous span.

3. The control system of claim 1 wherein:

the upstream roller comprises the driven roller with the drive adapted and configured for controlling the upstream driven roller; and the downstream roller comprises a further driven roller with a further drive adapted and configured for controlling the downstream driven roller.

4. The control system of claim 1 wherein:

the downstream roller comprises the driven roller with the drive adapted and configured for controlling the downstream driven roller; and the upstream roller comprises a further driven roller with a further drive adapted and configured for controlling the upstream driven roller.

5. The control system of claim 1 wherein the converting line has a further downstream roller downstream from the downstream roller along a further span, the downstream roller and further downstream roller being adapted to direct web material through the converting line along a further span defined by the downstream roller and the further downstream roller, the control system comprising:

a velocity sensor for the further downstream roller, the velocity sensor of the further downstream roller being adapted and configured to generate a velocity signal representative of a velocity of the web material at the further downstream roller; and wherein the controller is adapted and configured to use the web stiffness estimate and the velocity signal representative of a velocity of the web material at the further downstream roller to estimate a tension in the further span without direct web tension feedback within the further span.

6. The control system of claim 1 wherein the converting line has a further upstream roller upstream from the upstream roller, the upstream roller and further upstream roller being adapted to direct web material through the converting line along a further span defined by the upstream roller and the further upstream roller, the control system comprising:

a velocity sensor for the further upstream roller, the velocity sensor of the further upstream roller being adapted and configured to generate a velocity signal representative of a velocity of the web material at the further upstream roller; and wherein the controller is adapted and configured to use the web stiffness estimate and the velocity signal representative of a velocity of the web material at the further upstream roller to estimate a tension in the further span without direct web tension feedback within the further span.

7. The control system of claim 1 wherein the span stiffness estimate of the web stiffness estimator associated with the driven roller is a stiffness gain estimate, wherein the controller is adapted and configured to use the stiffness gain estimate to at least one of: (x) feed forward a control loop of the tension control module associated with the controller of the driven roller, (y) scale a bandwidth of a control loop of the tension control module associated with the controller of the driven roller, (z) set a bandwidth of a control loop of the tension control module associated with the controller of the driven roller.

8. The control system of claim 1 wherein the parameters representative of mechanical properties used by the controller in the mechanical characterization module associated with the controller of the driven roller are based on losses comprising at least one of static friction, viscous friction, and inertial components.

9. The control system of claim 1 wherein the controller is adapted and configured such that the instructions stored in memory, when executed by the processor, cause the processor to, within the web stiffness estimate module of the controller for the driven roller, generate the previous span tension signal in the span with directly measured web tension.

10. A method of controlling a converting line, the method comprising:

directing a web material through the converting line along a span defined by an upstream roller and a downstream roller positioned downstream in a direction of travel of the web from the upstream, wherein at least one of the upstream roller and downstream roller comprises a driven roller having a drive configured to control the driven roller;

with a torque sensor for the drive of the driven roller, generating a torque signal representative of a torque associated with the driven roller;

with a tension sensor associated with the span, sensing tension of the web in the span;

with a velocity sensor associated with the upstream roller, generating a velocity signal representative of a velocity of the web material at the upstream roller;

with a velocity sensor associated with the downstream roller, generating a velocity signal representative of a velocity of the web material at the downstream roller;

generating a velocity trim command signal for the drive of the driven roller with a controller associated with the driven roller by:

(a) enabling a mechanical characterization module of the controller associated with the driven roller to:

(i) receive the velocity signal from the driven roller velocity sensor (ii) receive the torque signal from the torque sensor of the drive of the driven roller, and (iii) based upon parameters representative of mechanical properties associated with the driven roller, generate a signal representative of an estimate of an applied web force at the driven roller;

(b) enabling a web stiffness estimator module of the controller associated with the driven roller to:

(i) receive the signal representative of the estimate of the applied web force from the mechanical characterization module;

(ii) receive the span tension signal from the span tension sensor;

(iii) receive the velocity signal from the velocity sensor of the upstream roller;

(iv) receive the velocity signal from the velocity sensor of the downstream roller; and (v) based upon the span length, the velocity signal from the velocity sensor of the upstream roller, the velocity signal from the velocity sensor of the downstream roller, the span tension signal from the span tension sensor, and the signal representative of the estimate of the applied web force from the mechanical characterization module, generate a signal representative of an estimate of a span stiffness, a signal representative of a tension estimate in a previous span of the web prior to the upstream roller, and a signal representative of a span time constant; and (c) enabling a tension control module of the controller associated with the driven roller to:

(i) receive the signal representative of the estimate of the span stiffness from the web stiffness estimator;

(ii) receive the previous span tension estimate from the signal from the web stiffness estimator;

(iii) receive the web span time constant from the web stiffness estimator;

(iv) receive the span tension signal from the span tension sensor; and (v) based at least in part upon the signal representative of the estimate of the span stiffness, the signal representative of the previous span tension estimate, the web span time constant, the span tension signal, and a span tension setpoint, generate the velocity trim command signal for the drive of the driven roller.

11. The method of claim 10 wherein within the web stiffness estimate module of the controller for the driven roller, the step of generating the previous span tension signal in the span includes generating the previous span tension signal without direct web tension feedback.

12. The method of claim 10 further comprising:

providing the upstream roller with the drive for controlling the upstream roller as the driven roller; and providing the downstream roller with a further drive for controlling the downstream roller as a further driven roller.

13. The method of claim 10 further comprising:

providing the downstream roller with the drive for controlling the downstream roller as the driven roller; and providing the upstream roller with a further drive for controlling the upstream roller as a further driven roller.

14. The method of claim 10 further comprising:

directing the web material along a further span defined by the downstream roller and a further downstream roller positioned downstream of the downstream roller in the direction of travel of the web from the downstream driven roller;

with a velocity sensor associated with the further downstream roller, generating a velocity signal representative of a velocity of the web material at the further downstream roller; and enabling the controller to use the web stiffness estimate and the velocity signal representative of a velocity of the web material at the further downstream roller to estimate a tension in the further span without direct web tension feedback within the further span.

15. The method of claim 10 further comprising:

directing the web material along a further span defined by the upstream roller and a further upstream roller positioned upstream of the upstream roller in the direction of travel of the web from the further upstream roller to the upstream roller;

with a velocity sensor associated with the further upstream roller, generating a velocity signal representative of a velocity of the web material at the further upstream roller; and enabling the controller to use the web stiffness estimate and the velocity signal representative of a velocity of the web material at the further upstream roller to estimate a tension in the further span without direct web tension feedback within the further span.

16. The method of claim 10 further comprising configuring the controller associated with the driven roller in a manner such that the span stiffness estimate of the web stiffness estimator associated with the driven roll is a stiffness gain estimate; and enabling the controller to use the stiffness gain estimate to at least one of: (x) feed forward a control loop of the tension control module associated with the controller of the driven roller, (y) scale a bandwidth of a control loop of the tension control module associated with the controller of the driven roller, (z) set a bandwidth of a control loop of the tension control module associated with the controller of the driven roller.

17. The method of claim 10 wherein the step of enabling the mechanical characterization module of the controller associated with the driven roller to generate the signal representative of the estimate of the applied web force at the driven roller based upon parameters representative of mechanical properties associated with the driven roller includes parameters based upon losses comprising at least one of static friction, viscous friction, and inertial components.

18. The method of claim 10 wherein within the web stiffness estimate module of the controller for the driven roller, the step of generating the previous span tension signal in the span includes generating the previous span tension signal with direct web tension feedback.

* * * * *